United States Patent [19]

Stephenson et al.

[11] 4,351,668

[45] Sep. 28, 1982

[54] FLOTATION OF CU AND PB SULFIDE CONCENTRATES CONTAINING CARBONATES

[75] Inventors: Leonard P. Stephenson, Yellowknife, Canada; Arthur A. Schweizer, Salem, Mo.

[73] Assignee: Cominco Ltd., Canada

[21] Appl. No.: 241,960

[22] Filed: Mar. 9, 1981

[51] Int. Cl.[3] ..... C22B 1/00; B03D 1/14

[52] U.S. Cl. ..... 75/2; 209/167

[58] Field of Search ..... 423/26; 75/2; 209/167

[56] References Cited

U.S. PATENT DOCUMENTS

| | | | |
|---|---|---|---|
| 1,079,107 | 11/1913 | Chapman | 75/2 |
| 1,799,166 | 4/1931 | Hooey | 423/109 |
| 2,105,901 | 1/1938 | Brinker | 209/167 |

FOREIGN PATENT DOCUMENTS

| | | | |
|---|---|---|---|
| 51-80614 | 7/1976 | Japan | 423/26 |
| 54-26842 | 9/1979 | Japan | 209/167 |

OTHER PUBLICATIONS

Gaudin, *Flotation*, 2nd Edition, McGraw-Hill, NY (1957), pp. 183, 198, 429, 430, 433, 522.

*Primary Examiner*—Brian E. Hearn

*Attorney, Agent, or Firm*—Neil F. Markva

[57] ABSTRACT

A process for the beneficiation of lead or copper-lead sulphide ore or concentrate containing calcium and magnesium carbonates wherein the ore or concentrate is conditioned with a limited amount of sulphuric acid to form an acidic slurry and subjecting the acidic slurry to froth flotation whereby an upgraded concentrate and a tailing comprising calcium and magnesium sulphate are obtained.

9 Claims, 1 Drawing Figure

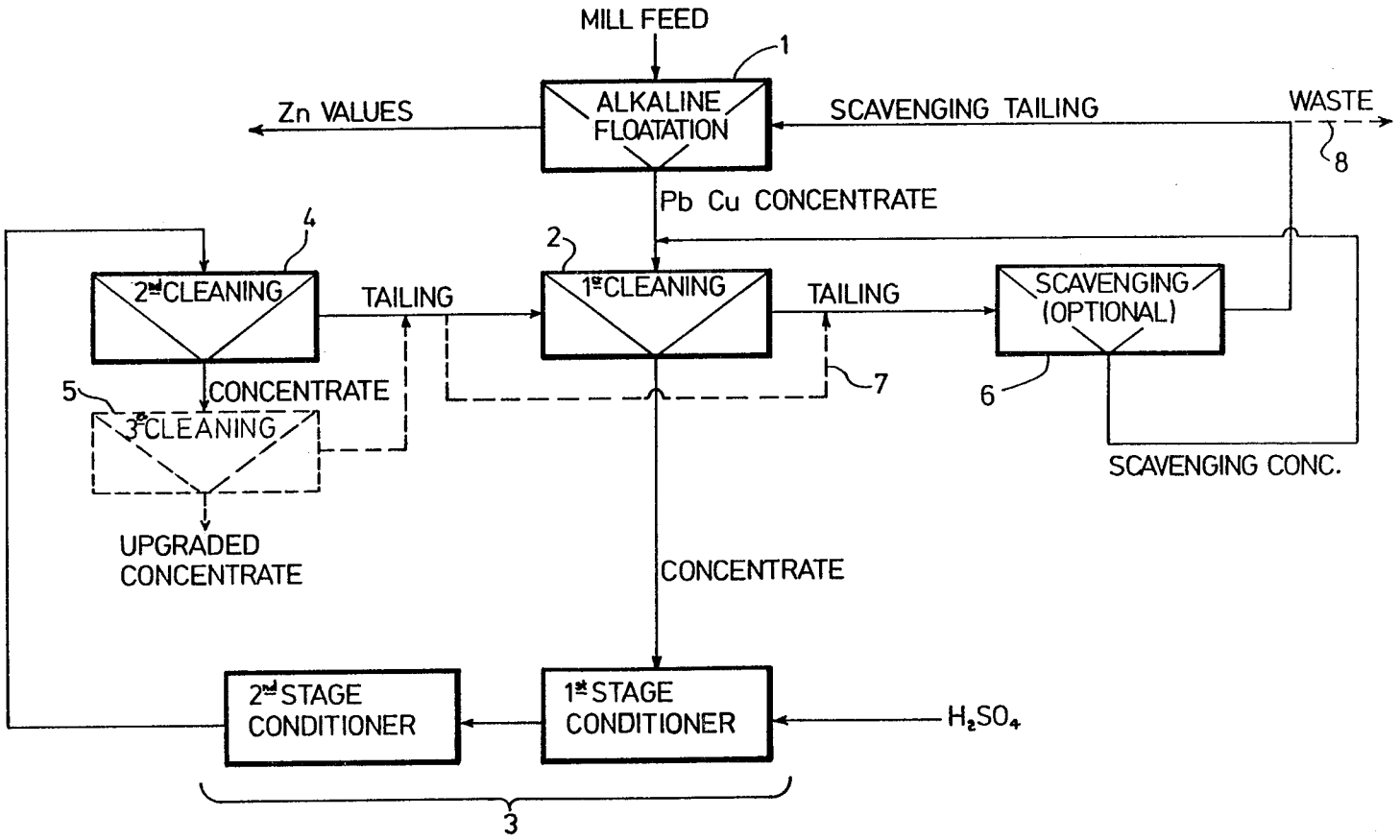
MILL FEED
ALKALINE FLOATATION
1
Zn VALUES
SCAVENGING TAILING
WASTE
8
Pb Cu CONCENTRATE
1st CLEANING
2
TAILING
SCAVENGING (OPTIONAL)
6
SCAVENGING CONC.
7
TAILING
2nd CLEANING
4
CONCENTRATE
3rd CLEANING
5
UPGRADED CONCENTRATE
CONCENTRATE
1st STAGE CONDITIONER
2nd STAGE CONDITIONER
$H_2SO_4$
3

FLOTATION OF CU AND PB SULFIDE CONCENTRATES CONTAINING CARBONATES

BACKGROUND OF THE INVENTION

This invention relates to the beneficiation of lead or copper-lead sulphide ore or concentrate and, more particularly, to a process for the beneficiation of lead or copper-lead sulphide ore or concentrate for the substantial removal of calcium and magnesium carbonates.

In the beneficiation of ores and the subsequent metallurgical treatments of the resulting concentrates for the recovery of metal values, the presence of calcium and magnesium carbonates results in lower grades of concentrates and imposition of smelter penalties.

In the early development of froth flotation methods of concentrating ores, bubbles of hydrogen sulphide or carbon dioxide which aided selective separation of minerals from gangue were formed by acidification of ores containing sulphides or carbonates. Reference is made to this procedure, for example, in U.S. Pat. No. 1,079,107 wherein it is noted that acid required for making bubbles may be too rapidly consumed. Controlled consumption of less sulphuric acid occurred when a bisulphate was added to the process.

U.S. Pat. No. 1,799,166 provides for treatment of zinc-bearing material with acid to convert water insoluble compounds of magnesium and calcium into relatively water soluble compounds. Sulphuric acid may be used to form magnesium sulphate and calcium sulphate. Although soluble magnesium sulphate is removed readily in a solids- liquid separation, repeated washings with water are needed to separate particles of calcium sulphate, which are only slightly soluble, from solids containing the zinc-bearing material.

The treatments of metal-bearing materials with acid according to the prior art have a number of distinct disadvantages, which include the lack of control of acid consumption which had to be corrected by addition of supplemental chemicals and the additional process steps of washing to eliminate calcium sulphate. It is noted, furthermore, that in the past, lead- and lead-copper-containing materials have not been known to be treated for the removal of magnesium and calcium carbonates.

STATEMENT OF INVENTION

We have now found that the acid treatment of lead or lead-copper sulphide ore or concentrate can be effectively carried out with a controlled amount of sulphuric acid for the substantial removal of contained magnesium and calcium carbonates without the above described disadvantages. Thus, we have found that by conditioning lead or lead-copper sulphide ore or concentrate containing magnesium and calcium carbonates with a limited amount of sulphuric acid and subjecting the resulting acid slurry to froth flotation, at least a portion of the carbonates can be effectively removed with the tailing which results in the substantial elimination of smelter penalties and an increase in the grade of concentrate.

It is, therefore, an object of the present invention to provide a process for the treatment of lead or copper-lead ore or concentrate for the substantial removal of contained carbonates. It is another object of the present invention to provide a process for the acid treatment of lead or lead-copper sulphide ore or concentrate to remove contained carbonates whereby smelter penalties incurred by the presence of carbonates in the concentrate are eliminated. It is a further object of the present invention to upgrade lead or lead-copper concentrates by acid treatment and flotation whereby calcium and magnesium impurities are separated as magnesium sulphate and calcium sulphate with the tailing.

According to the present invention there is provided a process for the beneficiation of lead or copper-lead sulphide ore or concentrate containing calcium and magnesium carbonate impurities, said process comprising conditioning the ore or concentrate with a limited amount of sulphuric acid thereby forming an acidic slurry, said limited amount being sufficient to provide a pH value in said conditioning of not less than 1.5 and subjecting said acidic slurry to froth flotation at a pH having a value in the range of about 5 to 6.5 in the presence of a collector for sulphide mineral, thereby forming a flotation product of concentrate comprising lead or lead-copper enriched concentrate and a residual slurry of tailing comprising calcium and magnesium as magnesium sulphate and calcium sulphate.

BRIEF DESCRIPTION OF THE DRAWING

The process of the invention will now be described in detail with reference to the accompanying drawing, in which:

The FIGURE is a flowsheet illustrating schematically the steps of the process of the invention.

DETAILED DESCRIPTION OF THE INVENTION

It is usual in the beneficiation of sulphide ores containing lead, copper and zinc to separate the copper and lead-containing material by flotation from zinc in an alkaline medium, depressed zinc-containing material being further treated to concentrate the zinc sulphide. In this flotation process, a portion of the carbonate impurities such as calcite and dolomite normally float with the lead and copper to provide a lower grade of lead or lead-copper concentrate as well as calcium and magnesium impurities in the concentrate which are undesirable in subsequent metallurgical treatments to recover lead and copper metals. In the process of the present invention, lead or copper-lead sulphide ores or concentrates, including concentrate obtained from the alkaline flotation for the removal of zinc concentrate, which ores and concentrates contain magnesium and calcium impurities such as calcite and dolomite, are conditioned with a limited amount of sulphuric acid and re-floated.

The sulphuric acid conditions the surface of the mineral particles and reacts with at least a portion of the calcite and dolomite with the formation of magnesium sulphate, calcium sulphate and carbon dioxide. When the solubility of calcium sulphate in the mineral-acid slurry is exceeded, gypsum precipitates. The amount of sulphuric acid is carefully controlled such that the pH in the conditioning does not decrease below a value of about 1.5. At a value of the pH below about 1.5 hydrogen sulphide may evolve which is to be avoided. The conditioning may be carried out in one or more stages and for a period of time of at least about 15 minutes. We have found that conditioning in two stages yields excellent results. When the ore or concentrate is conditioned in two stages, prefer to maintain the pH in the first stage at a value in the range of about 1.5 to 3.0. The value of the pH in the second stage will increase due to further reaction of the acid with the carbonates, reaching values in the slurry discharged from the conditioning which are usually in the range of about 5.0–6.5. We have found that in such a two-stage conditioning and re-flotation, a total retention time in the range of about 30 to 60 minutes is adequate for the removal of a major portion of the calcium and magnesium carbonates. It is understood, however, that, if desired, longer retention times may be used to provide the desired results.

The acidic slurry obtained from the conditioning is subjected to froth flotation to separate a flotation product comprising a lead or copper-lead sulphide enriched concentrate from tailing containing dissolved magnesium sulphate and calcium sulphate as well as depressed gypsum precipitate. Any one of a number of suitable collectors for sulphide minerals may be used. We have found, surprisingly, that a suitable xanthate collector can be effectively used in the flotation of the acid conditioned lead or lead-copper sulphide minerals. A suitable xanthate collector is, for example, potassium amyl xanthate. It is understood, however, that the invention includes the use of other suitable sulphide collectors. The flotation with a xanthate collector may be carried out in one or more stages with a pH usually in the range of about 5.0 to 6.5. Iron minerals such as marcasite (FeS) are not activated in the acid flotation.

The flotation product of enriched concentrate is preferably slurried with water and the slurry thus formed is refloated to effect a more complete separation of enriched concentrate from the calcium and magnesium, and to decrease the acidity of the concentrate, thereby reducing the corrosive effects the acid may have on process equipment during subsequent processing.

If desired, tailing may be subjected to a scavenging flotation and the final tailing may be rejected as waste or may be returned, wholly or in part, to the alkaline flotation for the further recovery of metal values, paticularly zinc. Normally, the acidic tailing is fed to the lead-copper rougher flotation.

In a preferred embodiment of the beneficiation process of the invention, as illustrated in the accompanying flowsheet, a lead or lead-copper sulphide concentrate, which is obtained from mill feed as a flotation product from an alkaline flotation process 1, wherein said concentrate is separated from zinc values, is subjected to a first cleaning flotation 2. The concentrate from this first cleaning is conditioned in two stages 3 with a limited amount of sulphuric acid to form an acidic slurry, which is then subjected to a second cleaning flotation 4. The concentrate from the second cleaning is recovered as final (upgraded) concentrate or, if desired, may be subjected to a third cleaning flotation 5, shown by broken lines, to remove a further amount of calcium and magnesium impurities. In most cases it is not necessary to add an additional amount of collector to the cleaning flotations. If desired, a frothing agent such as, for example, *Dowfroth 250 may be used.

*Trademark

The tailing from the second cleaning flotation 4, and from third cleaning flotation 5, if used, are shown returned to the first cleaning flotation 2. The tailing from the first cleaning flotation may be subjected to an optional scavenging flotation 6, in which case the scavenging concentrate is then passed to the first cleaning flotation 2, and the scavenging tailing is returned to the alkaline flotation circuit 1 for recovery of any contained metal values or discarded to waste via line 8. The tailing from the second cleaning flotation 4, and from third cleaning flotation 5, if used, can be passed directly to scavenging flotation 6 by by-pass line 7.

Using the process of the invention according to this preferred embodiment, as typified by the solid lines, in a concentrator, lead and lead-copper enriched concentrates were consistently obtained which contained 3 to 4% more lead than concentrates obtained without acid treatment, and which contained less than about 0.3% magnesium as MgO and 0.6% calcium as CaO, usually less than 0.2% and 0.3%, respectively.

The invention will now be illustrated by the following non-limitative examples.

EXAMPLE 1

A lead concentrate containing magnesium and calcium as dolomite was subjected to two-stage cleaning flotation without an acid treatment and with sulphuric acid conditioning of the concentrate from the first-stage cleaning flotation. The final concentrate obtained without acid treatment contained 74.48% Pb, 0.98% MgO and 1.60% CaO; and the lead recovery was 97.61%. The final concentrate obtained using acid conditioning of the present invention contained 78.48% Pb, 0.31% MgO, 0.62% CaO, for a lead recovery of 97.41%.

It can be seen from these figures that the conditioning with sulphuric acid of a lead concentrate containing magnesium and calcium impurities results in the upgrading of the concentrate and in the removal of a substantial portion of the contained magnesium and calcium without an appreciable reduction in the recovery of lead.

EXAMPLE 2

A copper-lead sulphide concentrate obtained from mill feed treated in an alkaline lead-zinc rougher flotation concentration was fed to a first-stage flotation cleaning. The concentrate from the first-stage cleaning was conditioned with 98% sulphuric acid in two stages for a period of 8 minutes in each stage. Sulphuric acid was added to the first-stage conditioner in an amount of 14 kg per ton of concentrate such as to maintain a steady-state value of the pH in the first-stage conditioner of 2.6. The conditioned concentrate was fed to a second-stage cleaning flotation. The tailing from the second-stage cleaning was passed to the first-stage cleaning and the tailing from the first-stage cleaning was removed from the process as cleaner tailing. The concentrate from the second-stage cleaning was recovered as copper- lead upgraded concentrate. In all flotation stages the residual potassium amyl xanthate from the alkaline flotation was the only collector present. A final flotation separation on the upgraded Cu-Pb concentrate produced a Pb concentrate and a Cu concentrate.

Analyses of the mill feed, the 1st cleaner feed, the acid conditioner feed, the 2nd cleaner feed, the upgraded copper-lead concentrate, the cleaner tailing, the final lead and copper concentrations and pH values, as well as percentage distributions of the upgraded copper-lead concentrate and cleaner tailing are shown in the following Table.

TABLE

| | Assay (%) | | | | | | |
|---|---|---|---|---|---|---|---|
| | pH | Pb | Zn | Cu | Fe | MgO | CaO |
| Mill Feed | 9.1 | 5.6 | .73 | .32 | 3.7 | 15.0 | 19.3 |
| 1st Cleaner Feed | 9.0 | 69.0 | .54 | 1.80 | 3.3 | $1.47^X$ | $1.80^X$ |
| Acid Conditioner | 7.6 | 75.4 | .50 | 1.60 | 2.8 | .70 | 1.25 |

TABLE-continued

| | | | | | | | |
|---|---|---|---|---|---|---|---|
| Feed | | | | | | | |
| 2nd Cleaner Feed | 5.7 | 73.4 | .69 | 2.20 | 3.5 | .63 | 1.32 |
| Upgraded Cu—Pb Conc. | 6.4 | 77.4 | .56 | 2.10 | 3.1 | .22 | .60[XX] |
| Cleaner Tailing | 7.6 | 8.7 | 2.20 | 4.90 | 8.5 | 10.6 | 11.0[XX] |
| Final Lead Conc. | 4.1 | 79.7 | .50 | .59 | 1.6 | .24 | .60 |
| Final Copper Conc. | 7.3 | 3.7 | .30 | 33.50 | 29.5 | .10 | .17 |

| | Distribution (%) | | | | | |
|---|---|---|---|---|---|---|
| | Pb | Zn | Cu | Fe | MgO | CaO |
| 1st Cleaner Feed | 100.0 | 100.0 | 100.0 | 100.0 | 100.0 | 100.0 |
| Upgraded Cu—Pb Conc. | 98.4 | 66.7 | 76.5 | 71.4 | 9.1 | 23.4 |
| Cleaner Tailing | 1.6 | 33.3 | 23.5 | 28.6 | 90.9 | 76.6 |

[X] = dolomite form
[XX] = gypsum form

The test results show that the magnesium and calcium impurity content in a lead sulphide concentrate can be effectively reduced by conditioning the concentrate with sulphuric acid at pH 2–3 followed by xanthate flotation at pH 5–6. Gypsum is effectively depressed and concentrated in the tailing.

Advantages of the process of the invention include improving the grade of concentrate and eliminating calcium and magnesium penalties levied by concentrate processors, improving settling and filtering rates and providing effective treatment of coarser particulate of feed permitted by the acid digestion of the carbonate gangue and recycle of solids not floated.

What we claim as new and desire to protect by Letters Patent of the United States is:

1. A process for the beneficiation of lead or copper-lead sulphide ore or concentrate containing calcium and magnesium carbonate impurities comprising conditioning the ore or concentrate in two stages, for a residence time in the conditioning of at least about 15 minutes, with a limited amount of sulphuric acid to form an acidic slurry, said limited amount of sulphuric acid being sufficient to provide a pH in the first stage in the range of about 1.5 to 3.0 without the evolution of hydrogen sulphide, and subjecting said acidic slurry to froth flotation at a pH in the range of about 5 to 6.5 in the presence of a xanthate collector for sulphide minerals for a flotation product of concentrate comprising lead or lead-copper enriched concentrate and a residual slurry of tailing comprising calcium and magnesium as magnesium sulphate, calcium sulphate, and precipitated calcium sulphate.

2. A process as claimed in claim 1, wherein the flotation product is slurried with water and the slurry thus formed is refloated in the presence of a collector for sulphide minerals to effect a more complete separation of said impurities in the tailing from the lead or copper-lead enriched concentrate.

3. A process as claimed in claim 1, wherein said lead or copper-lead sulphide concentrate is a lead or copper-lead sulphide concentrate obtained as a flotation product from an alkaline flotation process wherein said concentrate is separated from zinc values.

4. A process as claimed in claim 3, wherein at least a part of the tailing is returned to said alkaline flotation process.

5. A process as claimed in claim 1, or 2, which additionally comprises subjecting the lead or copper-lead sulphide ore or concentrate containing calcium and magnesium carbonate impurities to a rougher flotation prior to conditioning of said ore or concentrate, and returning at least a part of the tailing from the froth flotation of the acidic slurry to said rougher flotation.

6. A process as claimed in claim 1 or 2, wherein said collector is a xanthate collector for lead or copper-lead sulphide minerals.

7. A process as claimed in claim 1, wherein said lead or lead-copper sulphide concentrate is obtained from an alkaline flotation process wherein the ore or concentrate is beneficiated by substantial removal of zinc values, said concentrate is subjected to a first flotation cleaning to form a first flotation concentrate and a first tailing, said first flotation concentrate is conditioned in two stages with a limited amount of sulphuric acid to form an acidic slurry, said limited amount of sulphuric acid being not greater than the amount required to maintain the pH in the first stage at not less than about 1.5, said acidic slurry is subjected to a second cleaning flotation to form a second flotation concentrate and a second tailing, said two-stage conditioning and said second cleaning flotation being carried out for a period of time in the range of about 30 to 60 minutes, said second flotation concentrate is recovered as a lead or lead-copper enriched concentrate, said second tailing is passed to said first cleaning flotation and said first tailing is removed from the process.

8. A process as claimed in claim 7, wherein said second flotation concentrate is subjected to a third cleaning flotation prior to being recovered as enriched concentrate.

9. A process as claimed in claim 7, wherein said first tailing is subjected to a scavenging flotation prior to being removed from the process, the scavenging flotation concentrate is passed to said first cleaning flotation and at least a part of the scavenging tailing is returned to said alkaline flotation.

* * * * *